US006050519A

United States Patent [19]

Biagiotti

[11] Patent Number: 6,050,519

[45] Date of Patent: Apr. 18, 2000

[54] REWINDER INCORPORATING A TAIL SEALER

[75] Inventor: Guglielmo Biagiotti, Capannori, Italy

[73] Assignee: Fabio Perini S.p.A., Lucca, Italy

[21] Appl. No.: 09/051,772

[22] PCT Filed: Mar. 4, 1997

[86] PCT No.: PCT/IT97/00047

§ 371 Date: Apr. 20, 1998

§ 102(e) Date: Apr. 20, 1998

[87] PCT Pub. No.: WO97/32804

PCT Pub. Date: Sep. 12, 1997

[30] Foreign Application Priority Data

Mar. 5, 1996 [IT] Italy ..... FI96A0040

[51] Int. Cl.[7] ..... B65H 35/08

[52] U.S. Cl. ..... 242/526.1; 242/541.2

[58] Field of Search ..... 242/521, 526, 242/526.1, 541.2, 542.2, 580, 542, 542.1

[56] References Cited

U.S. PATENT DOCUMENTS

| | | | |
|---|---|---|---|
| 3,044,532 | 7/1962 | Ghisoni . | |
| 4,327,877 | 5/1982 | Perini . | |
| 4,475,974 | 10/1984 | Perini . | |
| 4,516,735 | 5/1985 | Snygg . | |
| 4,962,897 | 10/1990 | Bradley . | |
| 5,137,225 | 8/1992 | Biagiotti . | |
| 5,242,525 | 9/1993 | Biagiotti . | |
| 5,259,910 | 11/1993 | Biagiotti . | |
| 5,421,536 | 6/1995 | Hertel et al. | 242/526.1 |
| 5,690,296 | 11/1997 | Biagiotti | 242/521 |
| 5,769,352 | 6/1998 | Biagiotti | 242/521 |
| 5,839,680 | 11/1998 | Biagiotti | 242/541.2 X |
| 5,853,140 | 12/1998 | Biagiotti | 242/542.1 X |

FOREIGN PATENT DOCUMENTS

| | | |
|---|---|---|
| 0580561 | 1/1994 | European Pat. Off. . |
| 0611723 | 8/1994 | European Pat. Off. . |
| WO 9421545 | 9/1994 | WIPO . |

*Primary Examiner*—Donald P. Walsh
*Assistant Examiner*—William A. Rivera
*Attorney, Agent, or Firm*—Breiner & Breiner

[57] ABSTRACT

A method and apparatus for surface winding of a web material to form a roll is described, in which, at the end of the winding of the roll, the web material is severed to form a free tail edge and a free leading edge for the start of a subsequent roll. The completed roll is discharged directly from the winding area onto an adhesive applicator which applies an adhesive to the wound material. The free tail edge is rewound and covers the applied adhesive while the roll is discharged.

28 Claims, 11 Drawing Sheets

II
II
1
3
5
7
9
9A
9B
11
13
15
17
19
21
31
33
34
35
36
37
38
39
41
43
45
51
52
53
55
57
59
61
63
71
73
74
75
76
77
81
84
85
86
87
88
89
91
93
101
103
105
107
109
111
121
125
B
N
L

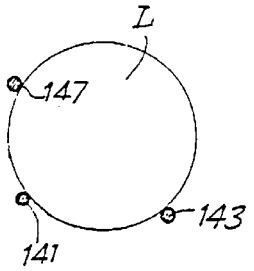
FIG. 2A
FIG. 3
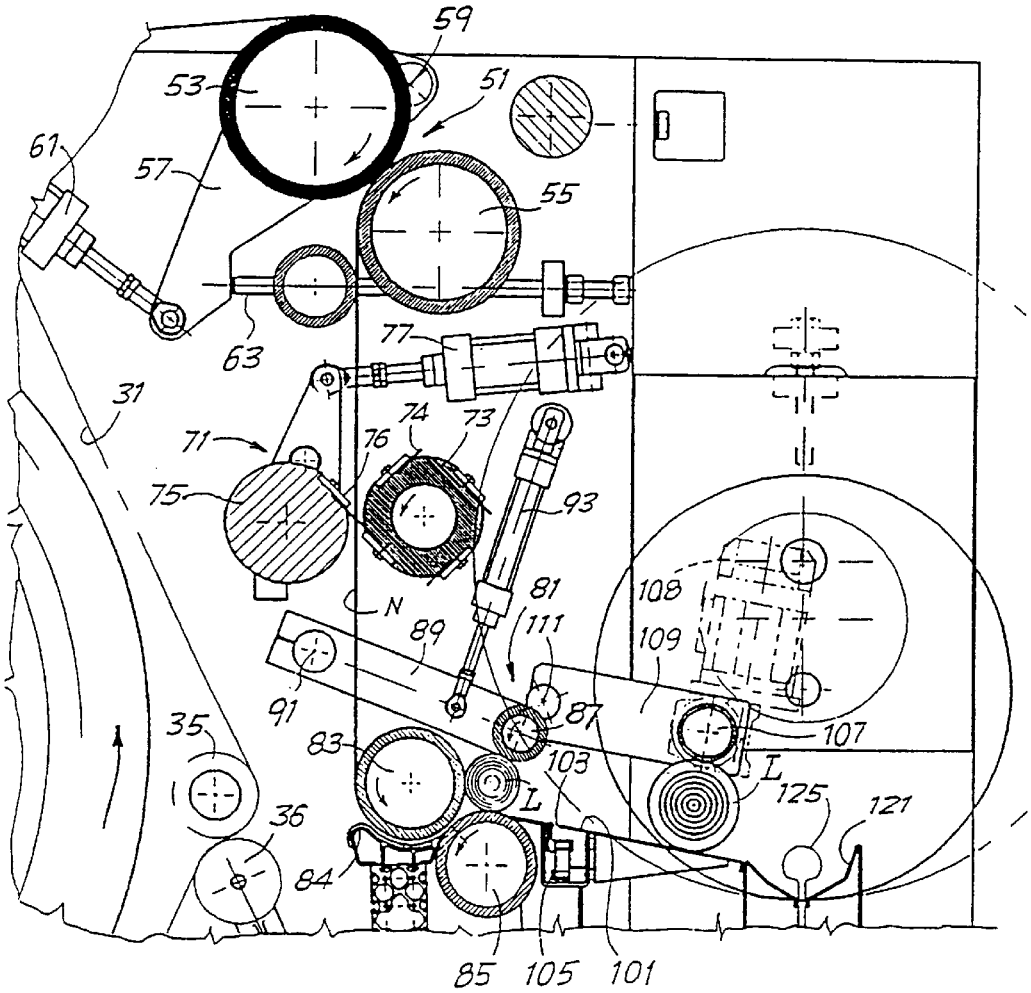

REWINDER INCORPORATING A TAIL SEALER

TECHNICAL FIELD

The present invention relates to an automatic surface rewinder for the formation of rolls or logs of web material. Rewinders of this type are commonly used for the production of rolls or logs of paper which are subsequently cut to produce smaller rolls of toilet paper, kitchen towels and similar.

BACKGROUND ART

There are many known types of rewinders, based on the principle of surface winding, for the production of rolls or logs of web material. Some examples of these automatic surface rewinders (in other words, those in which the logs are formed automatically in rapid succession and the log in formation is rotated by contact with an external system of belts or rollers) are described in U.S. Pat. No. 4,723,724, U.S. Pat. No. 4,856,725, U.S. Pat. No. 4,828,195, U.S. Pat. No. 4,962,897, U.S. Pat. No. 4,487,377, U.S. Pat. No. 4,931,130, U.S. Pat. No. 5,137,225, U.S. Pat. No. 5,248,106, U.S. Pat. No. 5,368,252, GB-A-2.105.688, WO-A-9421545.

Some of these rewinders, for example those described in EP-A-0 580 561 and EP-A-0 611 723 also produce logs without central winding cores.

These rewinders produce a high number of rolls per unit of time, and these are subsequently discharged to the exterior of the rewinder and are collected in a sorter or in an intermediate storage receiver. Before it is possible to proceed to the cutting of each log into smaller rolls and the subsequent packaging, it is necessary to glue the free tail edge of the web material wound on each log to prevent the unwinding of the end portion from causing problems in the subsequent phases, particularly in the packaging.

For this purpose, the logs discharged from the rewinder and collected in the accumulators or sorters following the machine are conveyed individually to a separate and subsequent section of the "converting" line in which one or more machines are provided for the gluing of the free tail edge of the material of each roll, these machines being commonly called tail sealers.

Examples of tail sealers are described in U.S. Pat. No. 3,044,532, U.S. Pat. No. 4,475,974, U.S. Pat. No. 4,963,223, U.S. Pat. No. 5,242,525, EP-B-0 481 929, WO-A-9515903, WO-A-9515902.

All the tail sealers have a station in which the free tail edge of the web material is unwound and positioned before the adhesive is applied.

The necessity of having a rewinder, an intermediate accumulator or sorter and a tail sealer (which in turn comprises a station for the unwinding and positioning of the free tail edge to be glued and a gluing station), causes the line to have large overall dimensions and makes it necessary to synchronize the different sections of the line with each other, resulting in high costs in respect of programming and control systems. These costs are accepted in plants with high output, of the order of more than 9–10 logs per minute, but cannot always be borne with lower outputs.

Disclosure of Invention

The present invention is based on the idea of combining the winding and gluing of the free tail edge of the log in a single section of the processing line, thus eliminating not only the intermediate accumulator or receiver, but also the station for the unwinding and positioning of the free tail edge of the log.

Essentially, according to the invention, the log is caused to be discharged as soon as it is formed from the winding cradle of the rewinder, with the tail edge unwound, directly onto a discharge surface along which the adhesive is applied to the roll to close the free tail edge during the rolling of the log on the discharge surface. The length of the free edge and the position of the adhesive on the roll are selected in such a way that as it is rewound the edge covers the line of adhesive and extends beyond it by a few millimeters, forming a tab that can be picked up. In this way the dimensions of the processing line are reduced drastically and also the programming and operation of the line are considerably simplified.

In practice, the method of winding according to the invention may comprise the phases of:

feeding the said web material to surface winding means;

winding a predetermined quantity of the said web material onto a roll;

dividing the web material;

discharging the roll formed by the said surface winding means, with a free tail edge of the said web material unwound from it, onto a discharge surface along which the said adhesive is applied to the cylindrical surface of the roll;

starting the winding of a new roll while the previously formed roll is discharged and glued.

The surface winding may be carried out by one of the conventional systems known at the present time. Preferably, the winding system which is used will comprise at least two winding rollers rotating in the same direction and forming between them a nip through which the web material to be wound passes. After the nip there is provided a winding area which is preferably formed by a third winding roller which is movable to permit and control the increase of the diameter of the log. If this winding system is adopted, at the end of the winding the web material is severed before the said winding cradle and the second winding roller is stopped to cause the completed roll to roll on it and to cause it to be discharged from the said winding cradle. By stopping the second winding roller, the roll can be discharged with a free edge of web material sufficiently long to allow convenient gluing, as will be shown more clearly by the following detailed description.

To improve the control of the phase of discharge of the log from the winding cradle, in this case it is advantageous to have the said first winding roller slowed down temporarily at the end of the winding, together with the rest of the machine, including the means of feeding the web material.

In practice, the adhesive is delivered from a delivery slit provided along the discharge surface and extending parallel to the axis of the roll.

The surface rewinding machine according to the invention comprises winding means forming a surface winding unit for the formation of the said rolls; before the said winding unit, means of dividing the web material which, at the end of the winding of a roll, sever the web material, thus generating a free tail edge of the web material wound onto the said roll and a free leading edge of web material for starting the winding of a subsequent roll; and a discharge surface after the said winding unit, onto which the formed rolls are discharged at the end of the winding. Delivery means are also disposed along the said discharge surface to deliver an adhesive to each of the said rolls when they roll on the said discharge surface, in order to glue the free tail edge of the web material wound on the roll, which is discharged by the winding unit onto the said discharge surface with the said free tail edge partially unwound.

In practice, the discharge surface has an adhesive delivery slit extending parallel to the axis of the roll. The log collects the adhesive from the slit as it rolls over it.

To obtain correct gluing of the free tail edge when the log rolls on the discharge surface, it is useful for the web material to be severed at the end of the winding in such a way that a sufficiently long free tail edge is left unwound from the log. This may be achieved, for example, by providing before the nip formed by the winding rollers a rolling surface forming with the surface of the said first winding roller a channel within which the winding of each roll starts. The web material is severed in the proximity of the entrance of the channel.

The severance of the web material may take place in various ways, depending among other considerations on whether the winding takes place with or without a central tubular core. Some examples of means of dividing the web material are described below.

BRIEF DESCRIPTION OF THE DRAWINGS

The invention will be more clearly understood from the description and the attached drawing, which shows a practical and non-restrictive example of the invention. In the drawing.

FIG. 2A is an enlarged detail through IIA—IIA in FIG. 2;

FIG. 3 is an enlargement of the winding area;

DETAILED DESCRIPTION OF THE INVENTION

The application of the invention to a compact processing line, in which the reel unwinding devices and the cutter which cuts the logs into smaller rolls are also present, is illustrated in the following description, and particularly with reference to FIGS. 1 to 4. This is intended to show how it is possible, by using the method and rewinder according to the present invention, to produce a line whose size is such that it can be entirely contained in a transport container. However, it should be understood that the inventive concept may also be applied to lines of different structure and configuration, for example in lines for the production of industrial rolls, in other words those of greater diameter.

Figure 1:
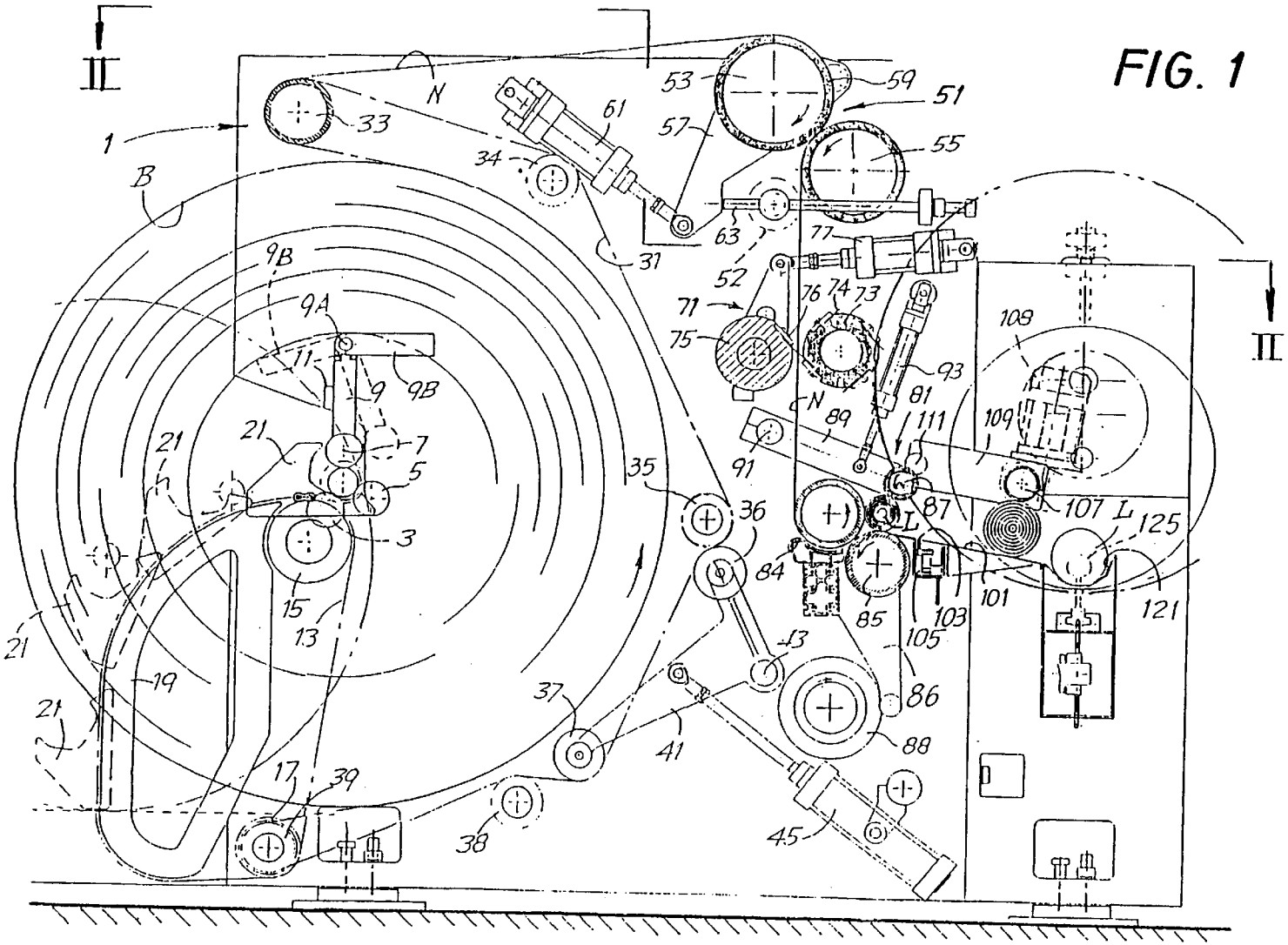
FIG. 1 is a side view, in partial section, of the processing line.
Figure 2:
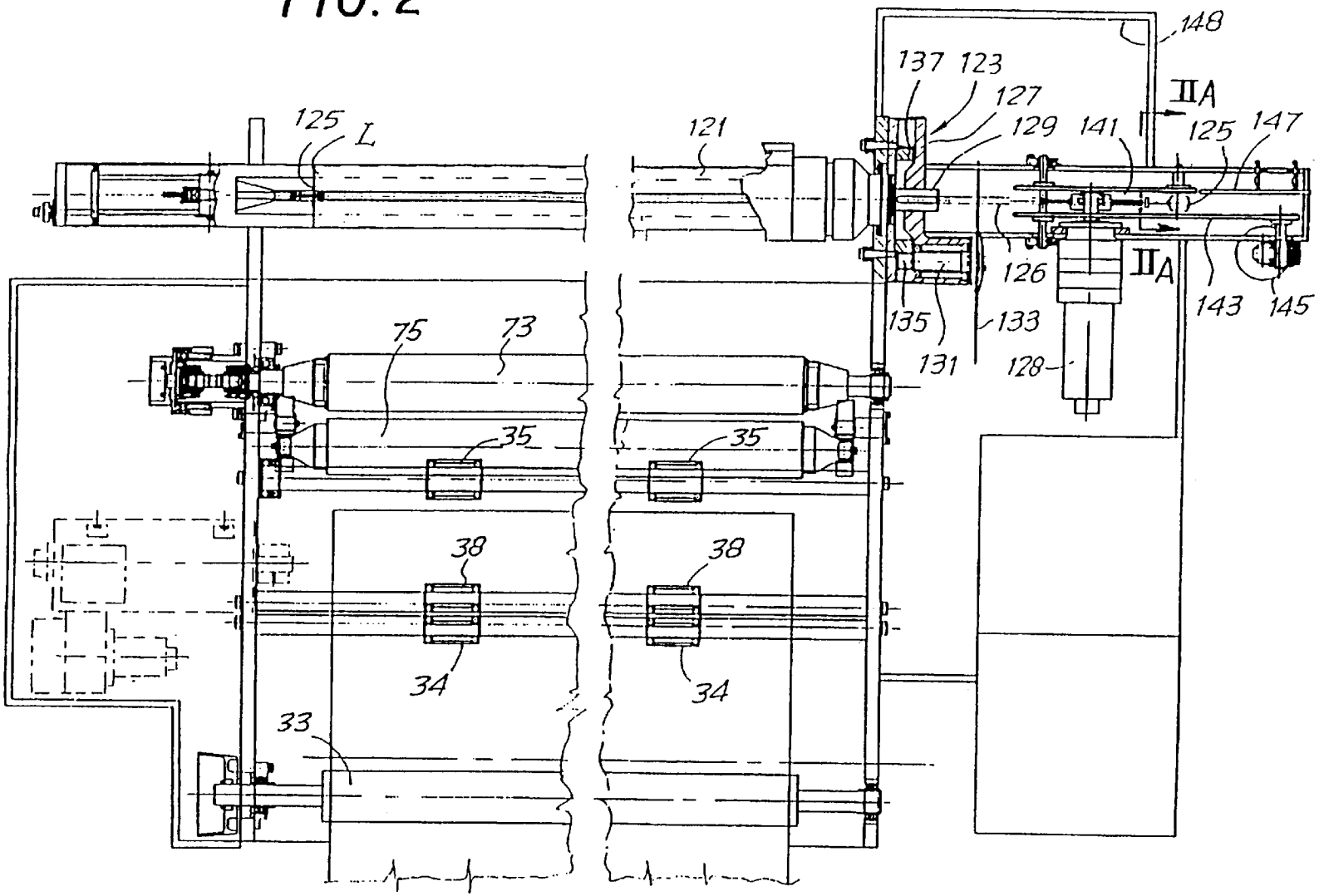
FIG. 2 is a plan view through II—II in FIG. 1.

With reference to FIGS. 1 to 3, the processing line, indicated in a general way by the number 1, comprises an unwinding station in which a reel of large diameter, indicated by B, of web material N is unwound so that it can then be rewound into logs or rolls whose diameter is equal to the diameter of the product intended for the end user. The reel B, with a central supporting axle A, is supported at both ends by a corresponding pair of idle support rollers 3, 5, and is held in this position by a third upper roller 7 supported by a bracket 9. The bracket 9 is hinged at 9A and has a counterweight 9B which in turn is hinged at 9A and oscillates with respect to the bracket 9. The counterweight 9B, in the angular position shown in FIG. 1, presses the bracket against a fixed stop 11. The stop is in such a position that when the bracket 9 presses against it the roller 7 is in such a position as to hold the core A of the reel B in the correct unwinding position.

The reel B is brought into this position by means of a pair of continuous parallel chains 13 which are located on the two sides of the machine, run around toothed wheels 15 and 17 and are guided by a corresponding curved guide 19. Each of the continuous chains 13 carries a support 21 designed to receive the corresponding end of the axle A inserted into the core of the reel B.

The two supports 21 and the guides 19 are shaped in such a way that they gently discharge the support axle A of the reel B onto the cradle formed by the support rollers 3 and 5, this operation being permitted by the anticlockwise oscillation of the bracket 9 which carries the third roller 7. When the axle A of the reel B has been positioned at the lowest possible point between the rollers 3 and 5, the roller 7 is returned by the action of the counterweight 9B to the position shown in FIG. 1, thus avoiding the risk of the reel B moving backwards. A forward fall is conveniently prevented by the fact that the roller 5 is disposed at a point higher than the roller 3. The core of the empty reel and the corresponding support axle A are then discharged from the seat 3, 5 by means of the said supports 21 which are made to move backwards by the chains 13. This movement is possible after the axle A has been released by a manual movement of the counterweight 9B to the position indicated in broken lines in FIG. 1. This causes a sufficient anticlockwise oscillation of the bracket 9 and of the roller 7 to release the axle A.

The reel B is unwound by means of a set of flat unwinding belts 31 which are parallel to each other, only one of which is visible in the drawing, the others being disposed parallel to it. The unwinding belt 31 is run around a powered cylinder 33 and a set of pulleys 34, 35, 36, 37, 38, 39. The return pulleys 36 and 37 are mounted on a bracket 41 pivoted at 43 on the corresponding side member of the machine and connected to a cylinder and piston actuator 45. With this disposition, the tension on the unwinding belt 31 is maintained when the diameter of the reel B varies.

The web material N, which is unwound from the reel as a result of the movement of the unwinding belts 31 and the friction between these and the external surface of the reel B, is run around the return cylinder 33 round which the belts 31 run, and passes through an embossing unit 51 comprising a pair of embossing cylinders 53, 55. The cylinder 53 is supported by a pair of brackets 57 (only one of which is visible in FIG. 1) pivoted at 59 on the corresponding side member and pressed by a pneumatic actuator 61 against an adjustable stop 63. In the illustrated example, the embossing cylinder 55 has a fixed axle. The embossing unit 51 may be omitted, in which case the web material N runs around a roller 52 indicated in broken lines in FIG. 1.

The web material N (whether embossed or not) then passes through a perforator unit 71, of a known type, which in the example shown in the drawing has a rotating perforating roller 73 with a plurality of blades 74 interacting with a fixed blade 76 carried by a non-rotating roller or beam 75, whose position can be adjusted by an actuator 77. The blades 74 or the blade 76 are serrated. In a known way, the perforator 71 makes a set of equidistant perforation lines on the web material N which, when processed in this way, is sent to a rewinding unit, indicated in a general way by the number 81.

The rewinding unit 81 comprises three winding rollers 83, 85 and 87, which are subsequently indicated as the first, second and third winding roller respectively, and which rotate in the same direction (anticlockwise in the example). The web material is run around the first winding roller 83 and is wound to form a log L which, in the intermediate processing phase shown in FIG. 1, comes into contact with the three rollers 83, 85, 87. The winding takes place in a known way and will not be described in great detail here, since reference may be made, for example, to the European Patent Application published under number EP-B-0 580 561, whose content is incorporated in the present description. At this point it is sufficient to note that the increase of the diameter of the log L is permitted by the oscillation of the arm 89, which supports the third winding roller 87, about its pivot 91. The oscillation is controlled by the actuator 93 which can be of any kind and is shown purely for convenience in the form of a cylinder and piston actuator. The roller 87 may also be raised by the growth of the log being formed. Additionally, the winding of the initial core of the log takes place between the first winding roller 83 and a curved rolling surface 84 carried by an oscillating unit 86 pivoted about the axis of the second winding roller 85. The oscillation of the unit 86 and consequently of the curved rolling surface 84 is caused by a cam 88 or other suitable system. As will be described in greater detail in the following text and as is moreover already known from EP-A-0 580 561, at the end of the winding of a log the oscillating unit 86 oscillates in the clockwise direction and the rolling surface 84 is brought into contact with the upper roller 83. In this way the web material is gripped between the rolling surface 84 and the roller 83, and breaks, and the free leading edge thus created starts to wind onto itself between the roller 83 and the rolling surface 84, advancing towards the nip formed between the roller 83 and the roller 85 to complete the winding of the new log between the three rollers 83, 85, 87. In this way a log L without a central tubular core is formed.

When the desired quantity of web material N has been wound onto the log, or when the log has reached the desired diameter or weight, the web material N is severed and the completed log L is discharged onto a discharge surface 101. The precise process by which the log L is discharged at the end of the winding will be described in the following text with reference to FIGS. 4A–4D.

The discharged log L rolls on the discharge surface 101, passing over an adhesive delivery slit 103. The adhesive is delivered by a delivery device indicated in a general way by the number 105 and disposed under the discharge surface 101 so that it glues the free tail edge of the log onto the external surface of the log. The adhesive delivery device 105 is not described in detail, since it may be made, for example, according to one of the solutions described in EP-B-0 481 929, U.S. Pat. No. 5,242,525, U.S. Pat. No. 5,259,910, WO-A-9515903. The principal characteristic of delivery devices of this type is that they interact with a log discharge surface, so that the gluing and the closing of the free tail edge take place simply by rolling on the discharge surface 101 along which the transverse adhesive delivery slit 103 is provided.

A log closing roller 107 is provided near the end of the discharge surface 101. The position of the roller 107 is adjustable by rotation of a support arm 109 pivoted at 111 on the structure of the machine. The roller 107 is rotated by a gearmotor 108 to cause the controlled rotation of the log, which passes between the roller 107 and the underlying discharge surface 101, and consequently the closure of the free tail edge. The position of the roller 107 and of its pivot 111 may be adjusted in such a way that the contact between the log and the roller 107 takes place in the area of application of the adhesive.

The log closed in this way is discharged into a cradle 121 of a cutter indicated in a general way by the number 123 (FIG. 2). In the cradle 121 the log L is made to advance by a pusher 125 towards a cutting head comprising a rotating plate 127 keyed to a driving shaft 129 which rotates it at a substantially constant velocity. The pusher 125 is carried by a continuous chain 126 running around two wheels, one of which is powered by a motor 128.

The rotating plate 127 supports a shaft 131 of a circular blade 133 for cutting the log L into rolls of the desired width. The rotation of the shaft 131 and consequently of the blade 133 is obtained by means of a pinion 135 keyed to the axle of the shaft 131 and engaging with a ring gear 137 coaxial with the axis of the plate 127 and integral with the fixed structure of the machine. The rotation of the plate 127 thus also causes the circular blade 133 to rotate about its own axis. The cutter described above has a more simple, more compact and more economical structure than that of normal cutters for logs.

The rolls cut by the blade 133 are pushed by the pusher 125 towards a conveyor consisting of a pair of small belts of circular section 141, 143, one of which extends further than the other. The two small belts 141, 143 are driven by a gearmotor 145 and discharge the rolls onto a conveyor which carries them to the packaging machine or other (not shown). The difference in length between the two belts permits the discharge of the trimmings, in other words of the two "slices" that are cut from the head and tail of the log. The trimmings are much narrower than the rolls and normally tilt, coming to rest on the small belts 141, 143 with their axis vertical. An adjustable smooth bar 147, positioned at a higher point than the small belt 141, as seen in the enlargement in FIG. 2A, is disposed after the small belt 141. The difference in height between the small belt 141 and the smooth bar 147 is such that the tilted trimmings pass under the smooth bar 147, fall, and are collected in the area beneath. Conversely, the rolls continue to advance, being supported on one side on the smooth bar 147, which allows them to advance easily by sliding, and on the other side on the small belt 143 which continues to convey them towards the exit of the line 1. Should the trimming fail to tilt before reaching the smooth bar 147, it will tilt as soon as it comes into contact with it, owing to the small axial dimension of the trimming and the friction torque, which cause it to lose its balance and consequently to fall into the space between the smooth bar 147 and the small belt 143.

The whole line described up to this point, with the sole exception of the small belts 141 and 143, the casing 140, and the guides 19 and corresponding chains 13 if present, may be housed in a transport container, having a length of 2200 mm, a height of 1950 mm and a width which in all cases is less than the largest dimension of the container.

This drastic reduction in size is obtainable also as a result of certain arrangements which are particularly useful for reducing the size of the line. In particular, a considerable reduction in length is obtained by the disposition of the gail sealer for the free tail edge, and of the corresponding delivery device 105, directly at the exit from the winding area formed by the rollers 83, 85, 87. As a matter of fact, by contrast with conventional lines, in which the tail sealer for the free tail edge of the log has a station for unwinding and positioning the free tail edge for gluing, in the illustrated processing line the operations of positioning the free tail edge are carried out as the final phase of the rewinding process itself, in other words of the process which takes place between the rollers 83, 85, 87.

Figure 4A:
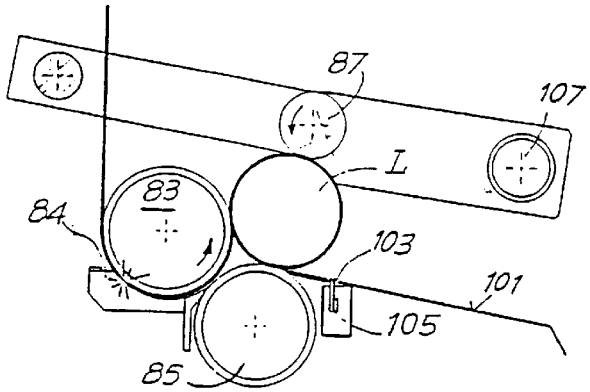
FIGS. 4A–4D show successive phases of the winding and gluing of the free tail edge of a log.

The operations of discharging the completed log, gluing the free tail edge and starting the winding of the next log are illustrated in FIGS. 4A–4D. The procedures of this phase, known as the exchange phase, are as follows: the second winding roller 85 is slowed down considerably (beyond the values of deceleration normally used in conventional rewinders), to zero velocity if necessary (FIG. 4A). The web material is gripped between the external surface of the roller 83 and the rolling surface 84 which is made to oscillate towards the roller 83. The web material N is torn along a perforation line as a result of the gripping and the rotation of the rollers 83, 87, in a way known to those skilled in the art, and known in particular, for example, from the publications cited in the present description. In particular, the break may be achieved by making a portion of roller have a surface with a low coefficient of friction, on which the material N is gripped and made to slide backwards with respect to the movement of the roller, causing the break, followed by a portion of surface with a higher coefficient of friction, as described in EP-A- 0 611 723, the content of which is incorporated in the present description.

Figure 4B:
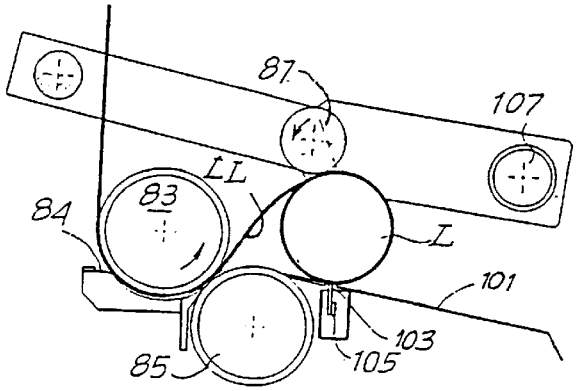
Figure 4C:
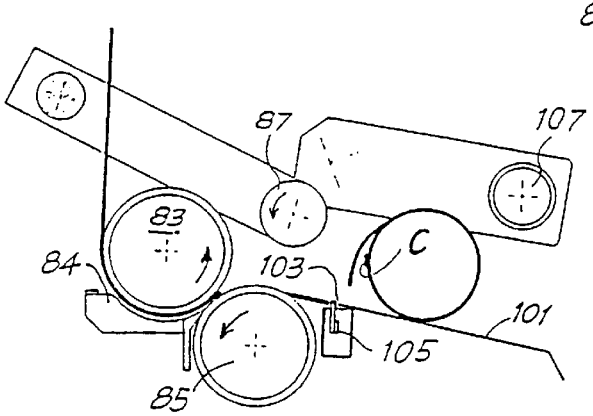

In this phase the speed of the machine, and in particular the peripheral velocity of the roller 83, are preferably reduced, with a consequent reduction in the speed of the feed of the web material N. The peripheral velocity of the roller 87 is also reduced proportionally, but is always kept higher than the peripheral velocity of the roller 85. The difference between the peripheral velocity of the roller 87 and that of the roller 85 causes the log L to roll on the roller 85 towards the discharge surface 101, until the log L ceases to be in contact with the roller 85 and is discharged onto the surface 101 (FIG. 4B).

These operations are synchronized and controlled in such a way that, when the log L starts to touch the discharge surface 101, the length of the free tail edge LL unwound from it is known and selected in such a way that, with allowance made for the subsequent rolling and consequently the gradual rewinding of the free tail edge on the log L, the log comes into contact with the transverse delivery slit 103 in the correct position to make the free tail edge adhere to the log in the proximity of the terminal line. For this purpose, the severance of the web material is made to take place at a sufficient distance from the log L to give a sufficient length of the unwound free tail edge. Additionally, to prevent the free tail edge from being rewound excessively onto the log L while the latter is rolling towards the discharge surface 101 and towards the delivery slit 103, the roller 85 is slowed down considerably or preferably brought to a halt.

Figure 4D:
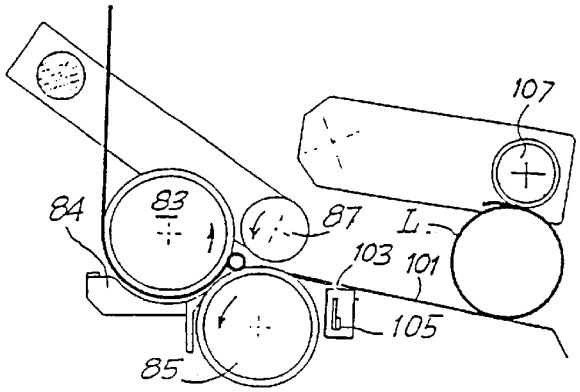

After the log L has touched the slit 103 and has consequently picked up the adhesive C (FIG. 4C), the rolling continues until the free tail edge LL is rewound completely onto the log L and covers the line of adhesive C, thus being fixed to the log (FIG. 4D). At the same time, the speed of the machine is returned to the operating level. The roller 85 is returned to the operating speed over a longer period, for the reason described below. The free leading edge created on the web material arriving from the reel B is wound onto itself in the channel formed by the rolling surface 84 and the surface of the roller 83, to form the central part of the new log (FIG. 4B). This initial winding turns roll until they pass through the nip formed by the rollers 83, 85 (FIGS. 4C, 4D) and are inserted into the winding cradle formed by the three rollers 83, 85, 87 (FIG. 4D) to form the next log. The passage through the nip is caused by the difference between the peripheral velocities of the rollers 83 and 85, which continues for the time necessary for the insertion of the initial winding turns into the said cradle, owing to the fact that the roller 85 returns to the operating speed over a longer period than the rollers 83, 87.

Figure 5A:
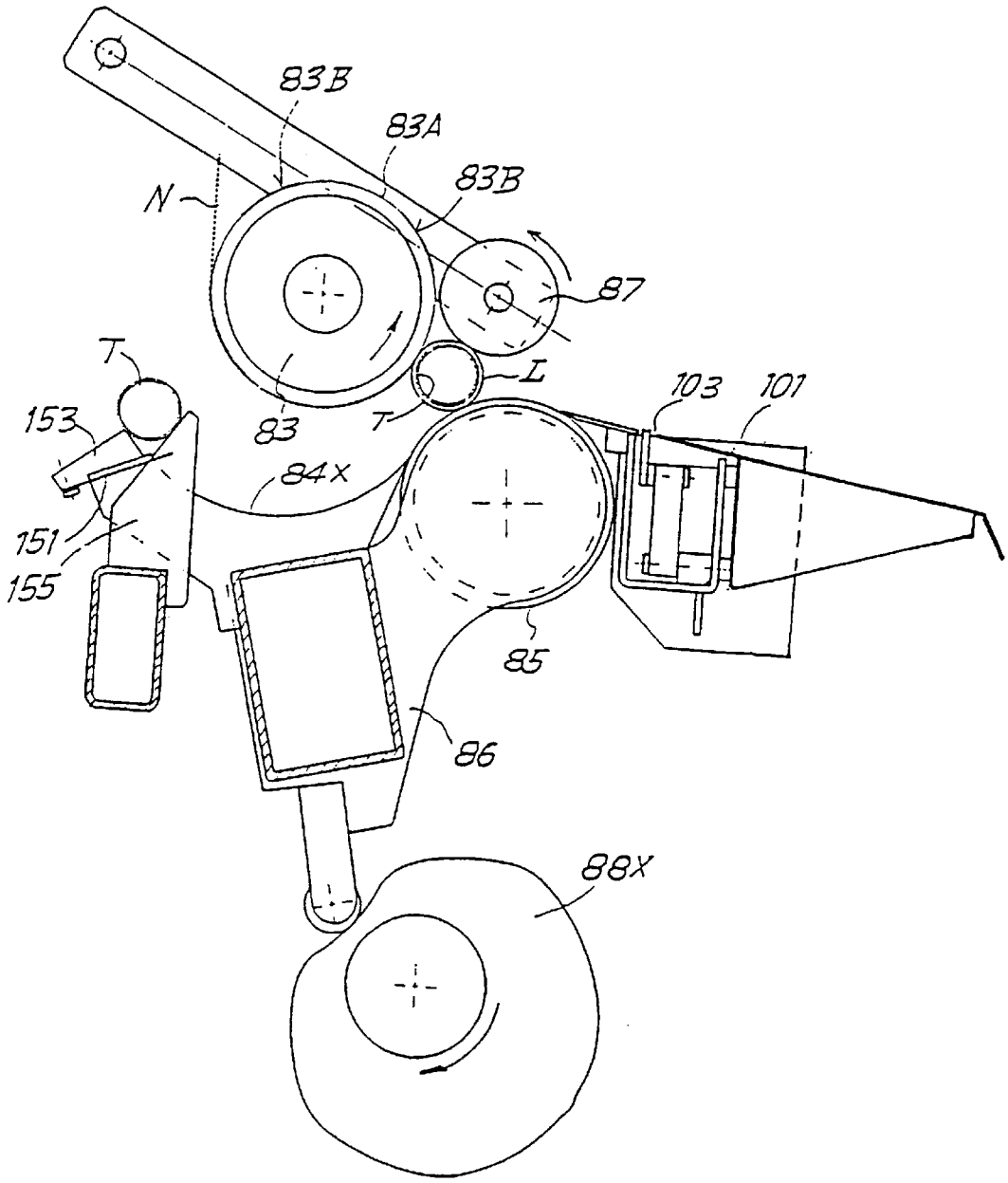
FIGS. 5A–5D show schematically, in four successive instants of the operating cycle, a solution in which winding cores are used.
Figure 5B:
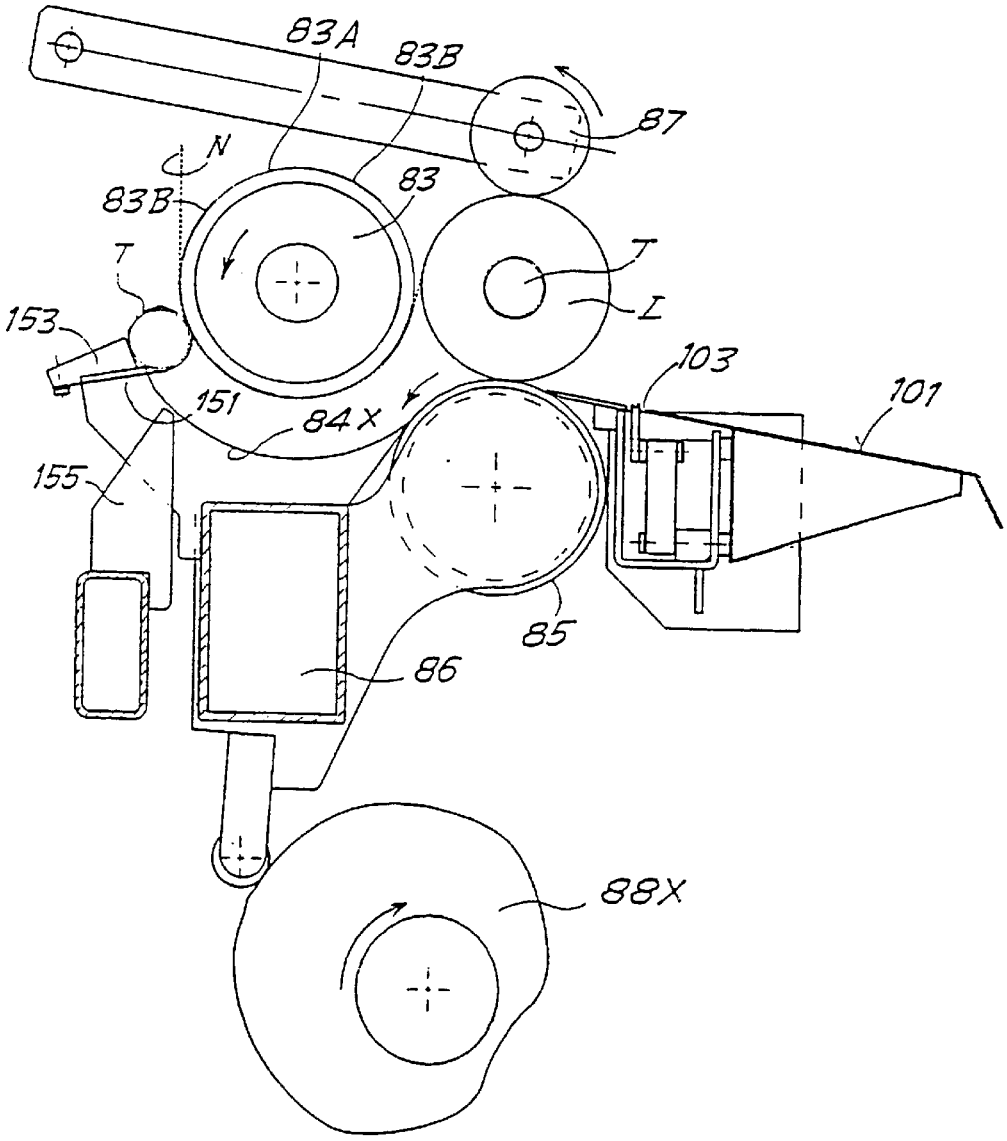
Figure 5C:
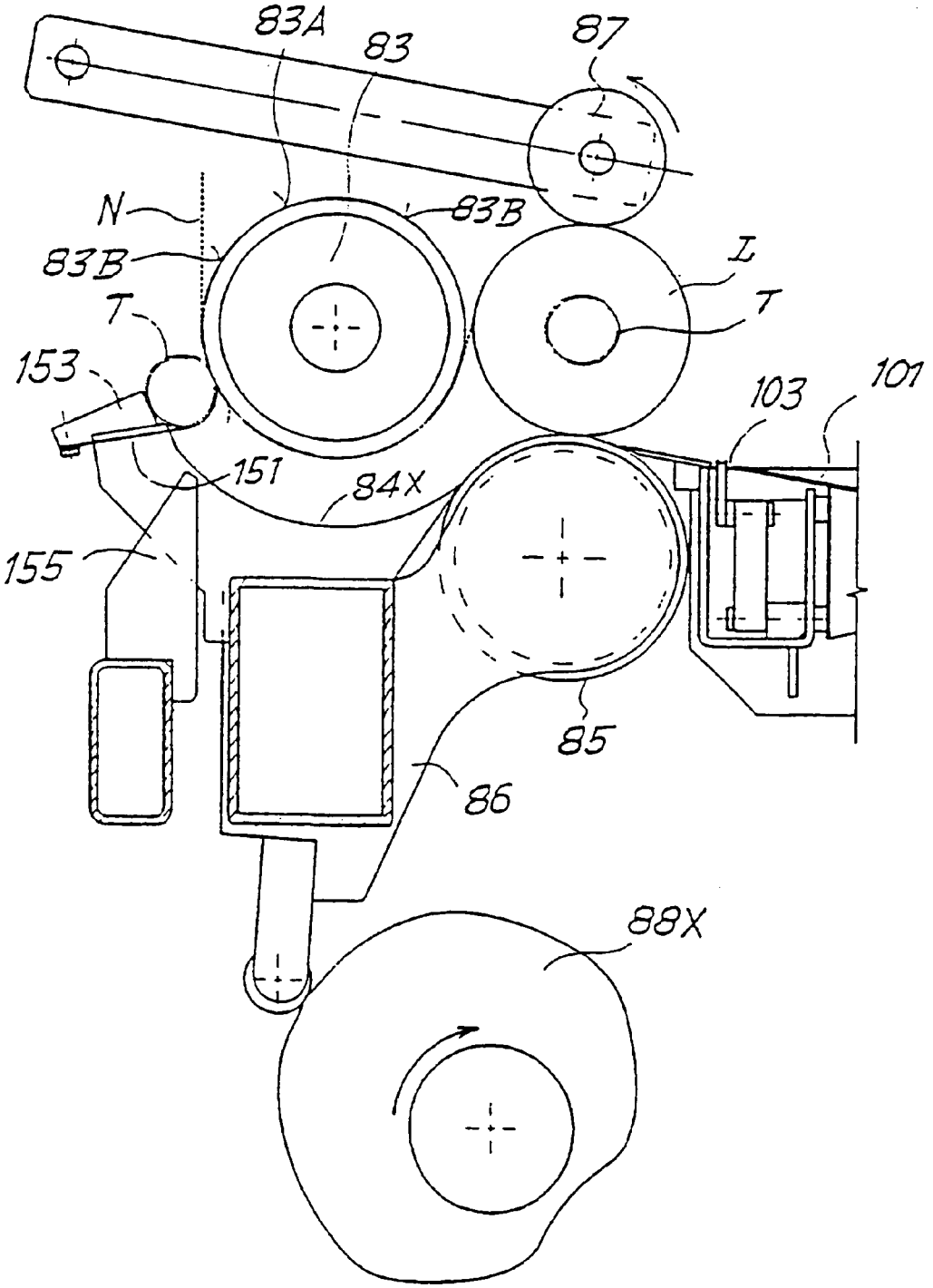
Figure 5D:
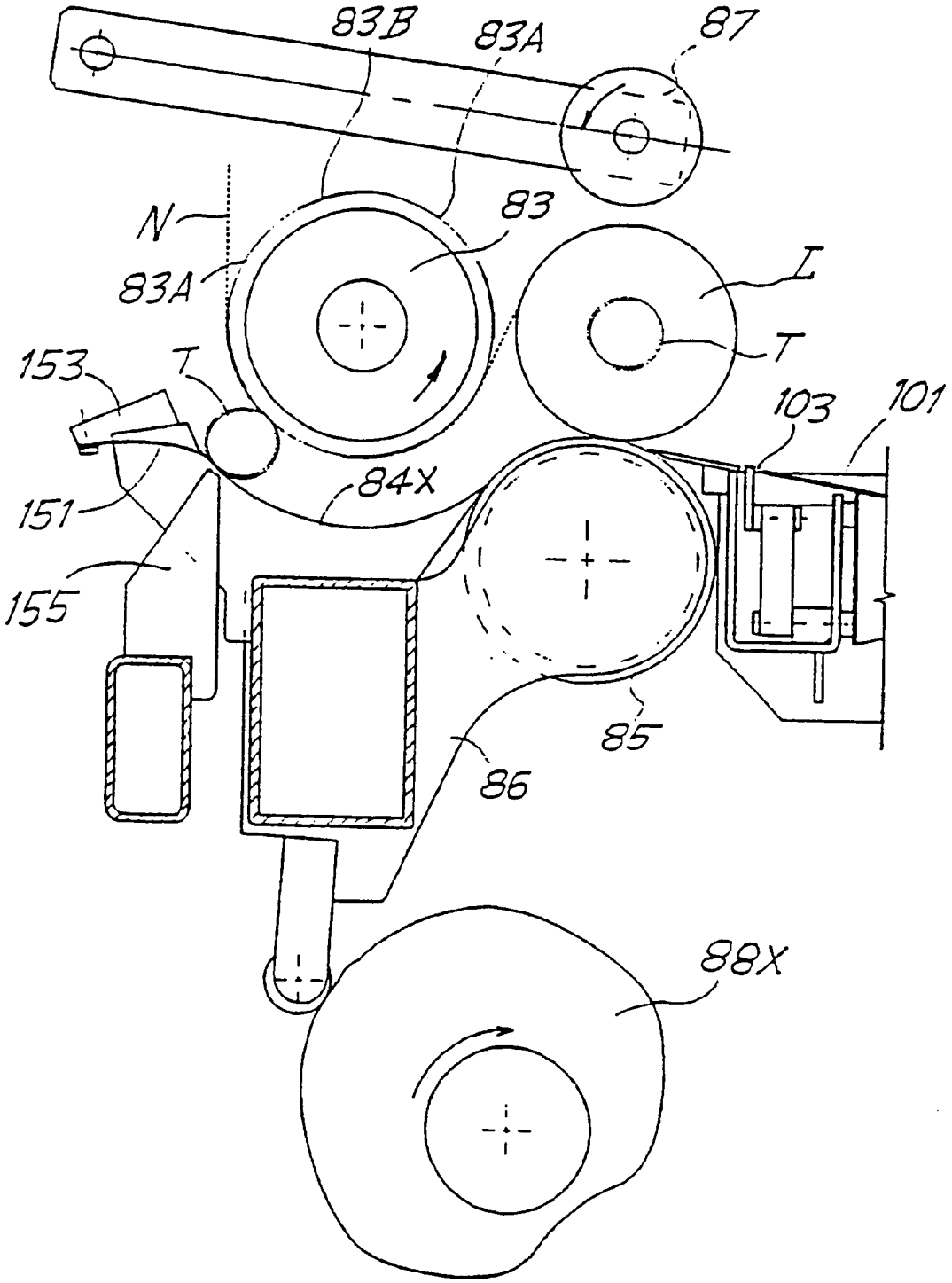

FIGS. 5A–5D show an embodiment in which the winding is done onto a tubular winding core T. Identical numbers indicate parts identical or corresponding to those described with reference to the preceding figures. The rolling surface before the nip between the rollers 83, 85 is indicated by 84X and is mounted on a unit 86X pivoted about the axis of the second winding roller 85. The number 88X indicates the cam causing the oscillation of the unit 86X and consequently of the rolling surface 84X. The distance between the rolling surface 84X and the cylindrical surface of the roller 83 is greater than in the preceding case. The rolling surface 84X is associated with an elastic plate 151 which forms, together with a support 153, a holder for a tubular winding core T. In FIG. 5A, where a log L is in the initial phase of winding between the rollers 83, 85, 87, the oscillating unit 86X is in its lowest position. In this position a tubular core T is inserted, laterally for example, and guided by a fixed support surface 155 which temporarily forms—together with the support 153—the core insertion holder. The insertion of the tubular core T, which has previously been provided with a line of adhesive parallel to its axis, may take place in a known way, for example as described in U.S. Pat. No. 4,931,130. While the winding of the log L continues, the unit 86X is raised until it reaches a position in which the tubular core T is kept at a very short distance from the surface of the winding roller 83 and is held there by the elastic plate 151 and the stop formed by the support 153. At the end of the winding of the log L, the core T is brought up to the surface of the roller 83 (FIG. 5B) and then pressed against it (FIG. 5C) by the further oscillation of the unit 86X. In the position shown in FIG. 5C, the web material N is gripped between the core T and the cylindrical surface of the roller 83 with consequent breaking of the web material N at a point intermediate between the gripping position and the completed log L. The machine is synchronized in such a way that in the vicinity of the core T there is a perforation line such that the breaking takes place at a point close to the tubular core T and not close to the log L, to create a sufficiently long free tail edge LL. The breaking is facilitated by the fact that four areas 83B with a high coefficient of friction (covered with abrasive cloth, for example) and, alternating with these, four areas 83A with a low coefficient of friction (made of polished steel, for example) are provided on the roller 83. The machine is synchronized in such a way that the tubular core T is pressed against a polished area 83A, while the perforation line on which the tearing takes places is located preferably in the area of transition between the area 83A on which the core presses and the area 83B with a high coefficient of friction adjacent to the former and after it with respect to the direction of advance of the web material.

When the tubular core T is pressed against the roller 83, it is made to rotate by the roller 83, and rolls along the rolling surface 84. The line of adhesive applied previously causes the free leading edge of the web material N to be fixed in such a way as to permit the start of the winding of a new log. The elastic deformation of the plate 151 allows the core to leave its holder and to roll on the rolling surface 84X.

The completed log is discharged onto the discharge surface 101 and its free tail edge LL is glued by the procedure described previously with reference to FIGS. 4A–4D.

In an alternative solution, the core T may be free of adhesive and the winding starts with the aid of one or more sets of nozzles, in a known way.

Figure 6:
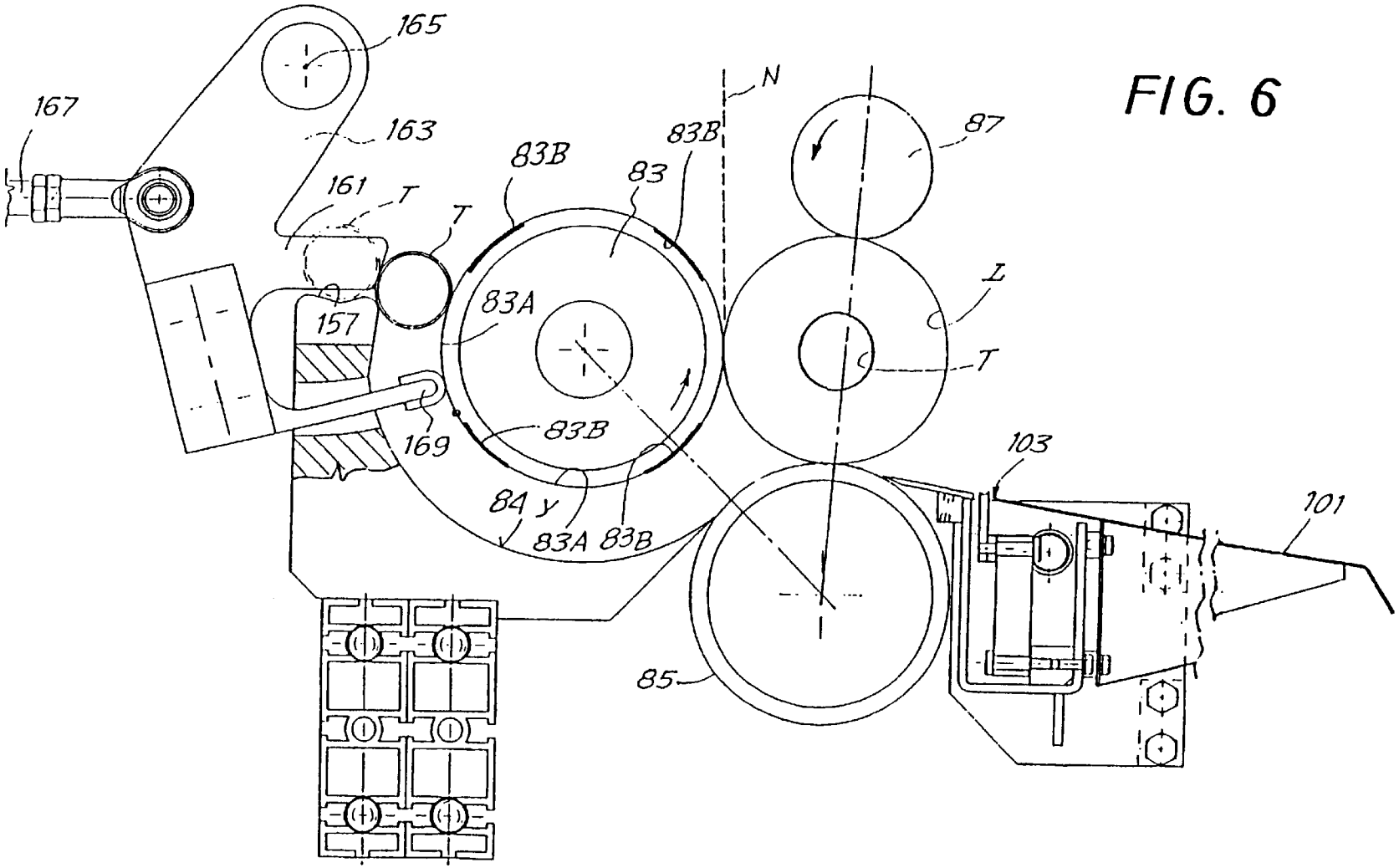
FIG. 6 shows schematically a further embodiment of the invention with a winding core.

FIG. 6 shows a solution for winding with a tubular core, in which the web material is broken by a member dedicated to this purpose, instead of by the pressure of the core. In this solution, a rolling surface 84Y, which is fixed instead of oscillating, is disposed before the nip formed between the two rollers 83, 85. This terminates in a holder 157 into which a tubular core T, which may have been previously provided with a line of adhesive, is inserted laterally. When the log L has been completed (the instant shown in FIG. 6), the tubular core T is pushed against the roller 83 by a pusher 161 carried by an oscillating unit 163 pivoted at 165 on the structure of the machine and driven by a cylinder and piston or equivalent actuator 167. The oscillating unit 163 also carries a presser 169 which, when the core is pushed by the pusher 161 against the external surface of the roller 83, grips the web material N between the presser 169 itself and the surface of the roller 83, causing the breaking of the web material N and consequently the generation of the free tail edge LL to be wound and glued onto the completed log L and the free leading edge which is fixed to the incoming tubular core T. In this case also, the roller 83 has portions of surface 83A, 83B with low and high coefficients of friction respectively. The tubular core T is then made to advance by rolling along the channel formed between the cylindrical surface of the roller 83 and the rolling surface 84Y until it reaches the nip between the rollers 83 and 85.

Figure 7:
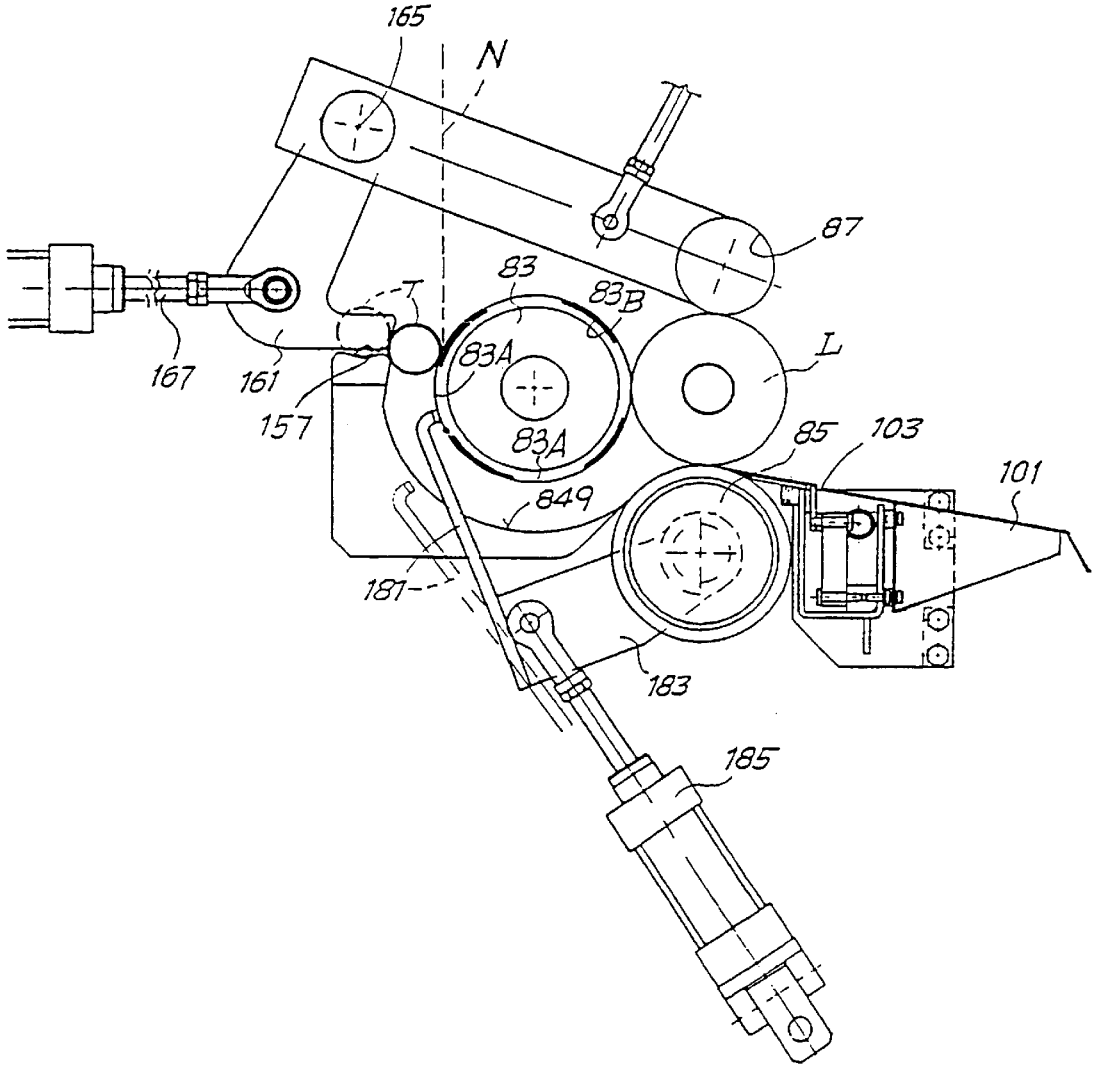
FIGS. 7 and 8 show a different embodiment in various phases of the operation.
Figure 8:
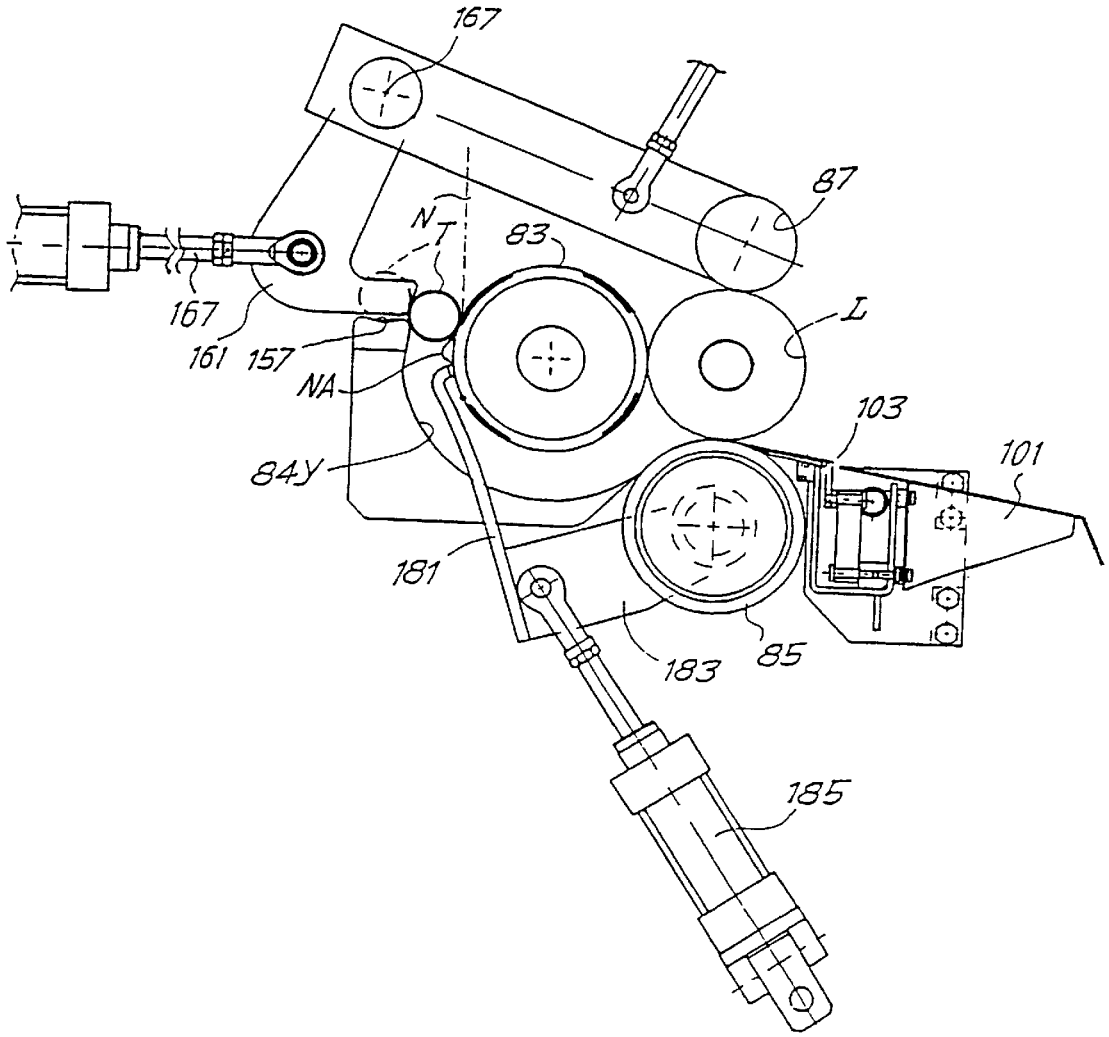

FIGS. 7 and 8 show a further embodiment of the invention, in which the logs are again formed on a tubular core. Parts identical or equivalent to those in FIG. 6 are indicated by the same reference numbers. In this embodiment, the means for dividing the web material N comprise an elastic plate or a plurality of parallel elastic plates 181 carried by an oscillating system 183 hinged about an axis which, in the example illustrated, coincides with the axis of rotation of the roller 85 (but which may, obviously, be positioned differently). The oscillation is caused by an actuator 185.

During the winding of a log L, the elastic plate 181 is held in the position indicated in broken lines in FIG. 7, while a new tubular core T is brought into the holder 157 indicated in broken lines in FIGS. 7 and 8. When the log L has been completed, the elastic plate 181 is brought into contact with the web material N running around the roller 83, and the tubular core T is pushed by the pusher 161 towards the entrance of the channel formed between the surface 84Y and the roller 83 and against the latter. The further pressure of the elastic plate 181 against the external surface of the roller 81 by means of the actuator 185 causes a flexional deformation of the plate (FIG. 8) and a consequent backward sliding of its end with respect to the direction of advance of the web material N. This causes the breaking of the web material on the perforation line which is immediately after the point of contact of the elastic plate 181. In this case also, the roller 82 is provided with portions of surface 83A and 83B with low and high coefficients of friction respectively. The elastic plate 181 touches the web material N next to a portion of surface 83A with a low coefficient of friction, so that the web material N can easily slide backwards as a result of the flexing of the elastic plate 181 and form a loop NA between the elastic plate 181 and the new tubular core T.

The free edge formed in this way can be applied to the new tubular core T by means of an adhesive previously applied to the core itself or by means of a suitable system of nozzles which generate air blasts (not shown).

In the embodiment shown in FIGS. 7 and 8, the severance of the web material N may take place even with the roller 83 completely halted, since the movement caused by the flexing of the elastic plate 181 is sufficient to cause the breaking of the web material. The solution described here therefore enables the web material N to be broken even with the machine stopped.

It should be understood that the drawing shows only an example provided solely as a practical demonstration of the invention, and that this invention may vary in its forms and dispositions without departure moreover from the scope of the guiding concept of the invention. Any presence of reference numbers in the attached claims has the purpose of facilitating the reading of the claims with reference to the description and the drawing, and does not limit the scope of protection represented by the claims.

I claim:

1. A method of surface winding a web material to form a roll comprising:

feeding said web material to a winding cradle;

winding said web material in said winding cradle to form a wound roll;

following formation of the wound roll, severing said web material to form a free tail edge on said wound roll and a free leading edge which serves as a start of a winding of a subsequent roll;

maintaining said free tail edge unwound from said wound roll while discharging said wound roll from said winding cradle onto an adhesive applicator in an absence of a tail edge unwinder or a tail edge positioner;

applying adhesive from said applicator to an external surface of said web material forming said wound roll;

winding said free tail edge onto said wound roll to cover said adhesive while discharging said wound roll from said adhesive applicator.

2. The method of claim 1, further comprising starting winding of the subsequent roll from said free leading edge while discharging said wound roll, applying said adhesive and winding said free tail edge on said wound roll.

3. The method of claim 1, wherein said winding cradle comprises first, second and third winding rollers, said rollers rotating in a common direction and said web material is guided on said first winding roller.

4. The method of claim 3, wherein said second of said winding rollers is temporarily stopped after said severing of said web material.

5. The method of claim 1, wherein said feeding of said web material is temporarily slowed following formation of said wound roll.

6. The method of claim 1, wherein said adhesive applicator includes a delivery slit extending parallel to an axis of said wound roll.

7. The method of claim 6, wherein said free tail edge is formed upstream of said wound roll and has a length remaining unwound sufficient to remain unwound when said wound roll contacts said delivery slit and is sufficient to cover said adhesive upon said winding of said free tail edge onto said wound roll.

8. The method of any one of claims 1, 2, 3, 4, 5, 6 or 7, wherein said feeding of said web material is temporarily stopped after formation of said wound roll, causing severing of said web material and sliding backwards of said web material on a surface of said winding cradle forming the free tail edge and the free leading edge.

9. A surface rewinder for winding a continuously fed web material into rolls comprising:

a winding cradle for forming said rolls;

severing means constructed and arranged to cause severance of said web material to form a free tail edge and a free leading edge, said severing means being positioned upstream of said winding cradle; and a discharge surface including an adhesive applicator;

wherein said discharge surface is positioned immediately downstream of said winding cradle in an absence of a tail edge unwinder or a tail edge positioner; and said adhesive applicator is positioned to apply adhesive to an exterior surface of said wound roll as said wound roll passes along said discharge surface to adhere said free tail edge to said wound roll.

10. The rewinder of claim 9, wherein said adhesive applicator includes a delivery slit extending parallel to an axis of said wound roll.

11. The rewinder of claim 9, wherein said winding cradle comprises first, second and third winding rollers, and further comprising driving means which rotate said winding rollers and which cause a temporary stop in the rotation of said second of said winding rollers after formation of said wound roll.

12. The rewinder of claim 11, wherein said driving means temporarily slows after formation of said wound roll.

13. The rewinder of claim 11, wherein said first and second winding rollers form a nip therebetween through which said web material passes and wherein a rolling surface is upstream of said nip, said rolling surface forming in conjunction with said first winding roller a channel within which winding of a roll begins.

14. The rewinder of claim 13, wherein said rolling surface is associated with a holder into which are inserted in succession winding cores on which rolls are formed.

15. The rewinder of claim 14, wherein said holder has an elastically deformable member for retaining a winding core, said member being deformed and releasing a core of said cores into said channel when said rolling surface is moved toward said first winding roller to bring said core into contact with said first winding roller.

16. The rewinder of claim 14, wherein said holder is associated with a pusher which pushes a core out of said holder against said first winding roller.

17. The rewinder of claim 16, wherein said pusher is associated with a presser, which when said core is pushed against said first winding roller, presses said web material against said first winding roller at a point between said wound roll and a point of contact between said core pushed by said pusher and said first winding roller.

18. The rewinder of claim 17, wherein said presser comprises a flexible elastic plate which, by pressing said web material against said first winding roller, causes the web material to move backwards and consequently break.

19. The rewinder of any one of claims 9, 10 or 12 in which said winding cradle comprises at least first and second winding rollers forming a nip therebetween through which said web material passes, and wherein a rolling surface is upstream of said nip, said rolling surface forming in conjunction with said first winding roller a channel within which winding of a roll begins.

20. The rewinder of claim 10, wherein said rolling surface is movable with respect to said first winding roller.

21. The rewinder of claim 20, wherein said rolling surface is associated with a holder into which are inserted in succession winding cores on which rolls are formed.

22. The rewinder of claim 21, wherein said holder has an elastically deformable member for retaining a winding core, said member being deformed and releasing a core of said cores into said channel when said rolling surface is moved toward said first winding roller to bring said core into contact with said first winding roller.

23. The rewinder of claim 21, wherein said holder is associated with a pusher which pushes a core out of said holder against said first winding roller.

24. The rewinder of claim 10, wherein said rolling surface is associated with a holder into which are inserted in succession winding cores on which rolls are formed.

25. The rewinder of claim 24, wherein said holder has an elastically deformable member for retaining a winding core, said member being deformed and releasing a core of said cores into said channel when said rolling surface is moved toward said first winding roller to bring said core into contact with said first winding roller.

26. The rewinder of claim 24, wherein said holder is associated with a pusher which pushes a core out of said holder against said first winding roller.

27. The rewinder of claim 26, wherein said pusher is associated with a presser, which when said core is pushed against said first winding roller, presses said web material against said first winding roller at a point between said wound roll and a point of contact between said core pushed by said pusher and said first winding roller.

28. The rewinder of claim 27, wherein said presser comprises a flexible elastic plate which, by pressing said web material against said first winding roller, causes the web material to move backwards and consequently break.

* * * * *